United States Patent [19]

Baxter

[11] 4,231,175

[45] Nov. 4, 1980

[54] VARIABLE-VISIBILITY FILING SYSTEM

[75] Inventor: Kenneth W. Baxter, N. Hollywood, Calif.

[73] Assignee: Baxter Associates, Inc., Burbank, Calif.

[21] Appl. No.: 910,236

[22] Filed: May 30, 1978

[51] Int. Cl.[3] ..... G09F 19/00

[52] U.S. Cl. ..... 40/374; 40/404; 211/51; 211/181; 220/22.5; 312/187

[58] Field of Search ..... 40/513, 509, 510, 530–531, 40/535–537, 372–375, 377, 379, 380, 383, 359, 360, 403, 404, 158 R, 158 B, 159; 211/51, 181, 184; 312/138 A, 42, 184, 185, 187; 220/22.3, 22.4, 22.5

[56] References Cited

U.S. PATENT DOCUMENTS

| | | | |
|---|---|---|---|
| 2,198,004 | 4/1940 | Elliott | 220/22.4 |
| 2,226,519 | 12/1940 | Larsen | 402/80 R X |
| 3,114,459 | 12/1963 | Kersting | 211/181 X |
| 3,295,697 | 1/1967 | Patterson | 312/184 X |
| 3,301,263 | 1/1967 | Spees | 40/380 |
| 3,347,393 | 10/1967 | Frey | 211/51 |
| 3,739,918 | 6/1973 | Kreitzburg | 211/184 X |
| 3,848,748 | 11/1974 | Ceccarelli | 211/181 |
| 3,913,250 | 10/1975 | Spees | 40/380 |
| 3,929,248 | 12/1975 | Morrison | 211/184 X |

FOREIGN PATENT DOCUMENTS

| | | | |
|---|---|---|---|
| 813702 | 5/1969 | Canada | 211/184 |

*Primary Examiner*—John F. Pitrelli
*Assistant Examiner*—G. Lee Skillington
*Attorney, Agent, or Firm*—Robert Louis Finkel

[57] ABSTRACT

Microfiche cards and the like are held in a file enclosure between file-segregator cards. The segregator cards are shaped to fit on and slide along longitudinal rails. To promote fanning of the segregator cards when they are compressed in a particular way, they have added thickness in a zone near their bottom edges. Two independently adjustable compressors are provided, one above and one below the added-thickness zone. By manipulation of the compressors a user can fan the file to a desired extent, controlling the fraction of the group of segregator cards which fans, and the angle between the adjacent fanned segregator cards, or can maintain the file tightly closed.

10 Claims, 3 Drawing Figures

FIG. 1
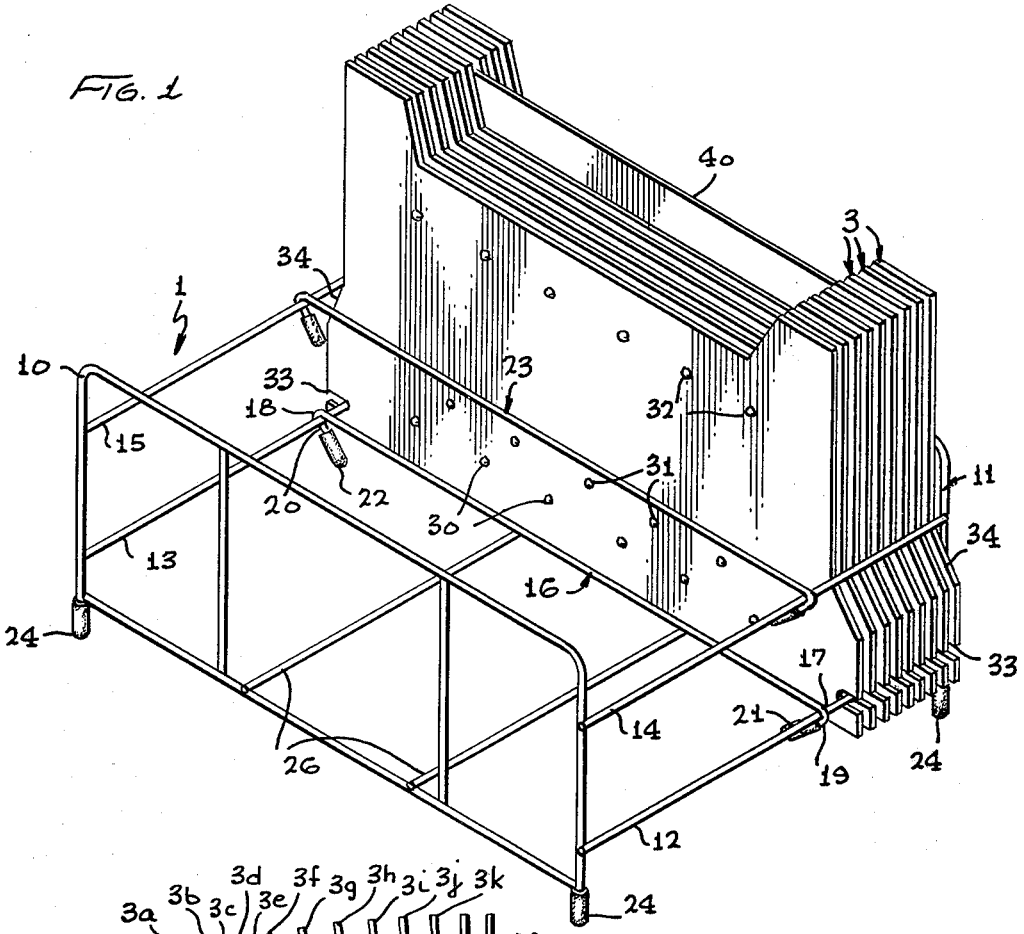
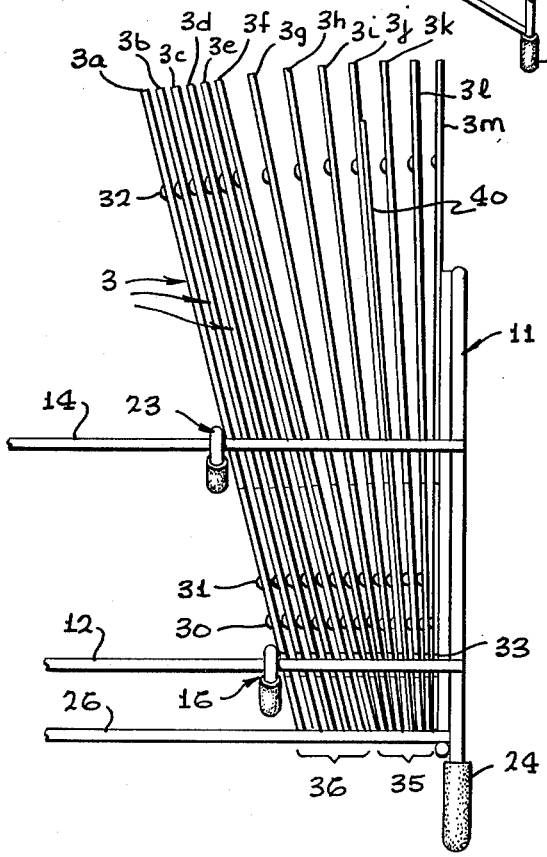
FIG. 2

VARIABLE-VISIBILITY FILING SYSTEM

BACKGROUND OF THE INVENTION

1. Field of the Invention

My invention is in the field of filing systems, particularly for small, single-sheet information units such as microfiche cards.

2. Prior Art

Hundreds of prior-art filing systems have been devised in attempts to find the best accommodation of two conflicting requirements: overall compactness, and title-block visibility. To the extent that certain of these attempts have succeeded, the resulting systems have generally been relatively elaborate and costly, and have afforded the user little or no control over the parameters of the title-block-display process.

In the particular area of microfiche filing systems the state of the prior art is exemplified by U.S. Pat. No. 3,913,250, which issued Oct. 21, 1975 to Arthur T. Spees.

Spees shows that selected backing cards in a file enclosure can be made to fan apart for inspection of the title areas of the backing cards, or the title areas of microfiche cards or the like placed between the backing cards.

The fanning effect is provided in part by increased thickness of each backing card along a line near the bottom edge of the card. To make use of this fanning effect, a user sets the length of the enclosure and manipulates the backing cards in certain ways.

Unfortunately, however, the number of cards which can fan out at one time, and the angles between adjacent fanned cards, are not under the user's control; such parameters are predetermined by geometrical factors. These factors are the basic thickness of each card itself, the amount of increased thickness provided, and the distance of said line from the bottom edge of each card. These factors are all established at the time of manufacture of the backing cards.

Thus the prior art leaves unsolved the problem of providing a simple, economical fan-type microfiche filing system whose user can control, at the time of use, in a continuously adjustable fashion, the parameters of the fanning action. My invention is addressed to this problem.

BRIEF DESCRIPTION OF THE INVENTION

The present invention provides a filing system in which an entire group of file segregator cards, with microfiche cards between them, can be fanned to a variable extent by manipulating two independently adjustable compressors at one end (preferably the rear) of the file. More specifically, both the fraction of the group which is subject to fanning and the angle between adjacent file segregator cards when fanned are subject to the user's control.

The file segregator cards are hereinafter called "segregators".

The variable fanning action is provided by cooperation between the two independent compressors, one higher than the other, and an increased-thickness zone on each segregator. The increased-thickness zone is at a height between the heights of the two compressors.

The segregators are shaped to fit on and slide along a pair of longitudinal (that is, front-to-back) rails, preferably at the sides of the enclosure. This arrangement retains the cards at the correct height for cooperation of the increased-thickness zone with the compressors.

The segregators also are made of a material which has electrostatic attraction for typical microfiche cards—and which thereby tends to hold the microfiche cards in the file even when the compressors are not tightened and the file is inverted.

In preferred embodiments the compressors are simply transverse rods which slide longitudinally along respective pairs of rails at the sides of the enclosure. To hold the transverse rods on the rails, and to apply friction to lock the compressor adjustments made by the user, the transverse rods are advantageously bent tightly partway around the rails. However, other mounting and adjustment-locking arrangements could be employed within the scope of my invention. One of the two transverse compressor rods may slide on the same pair of rails as do the segregators.

The features and advantages of my invention may be more-readily understood and appreciated from the discussion which follows hereunder and the accompanying drawings, of which:

DESCRIPTION OF THE DRAWINGS

FIG. 1 is an isometric view of the enclosure, compressors and segregators of a preferred embodiment of my invention. This view is taken looking at an angle from the rear of the enclosure.

FIG. 2 is an orthographic side elevation of part of the same embodiment, showing the compressors and segregators in a particular condition.

DETAILED DESCRIPTION OF THE INVENTION

Figure 3:
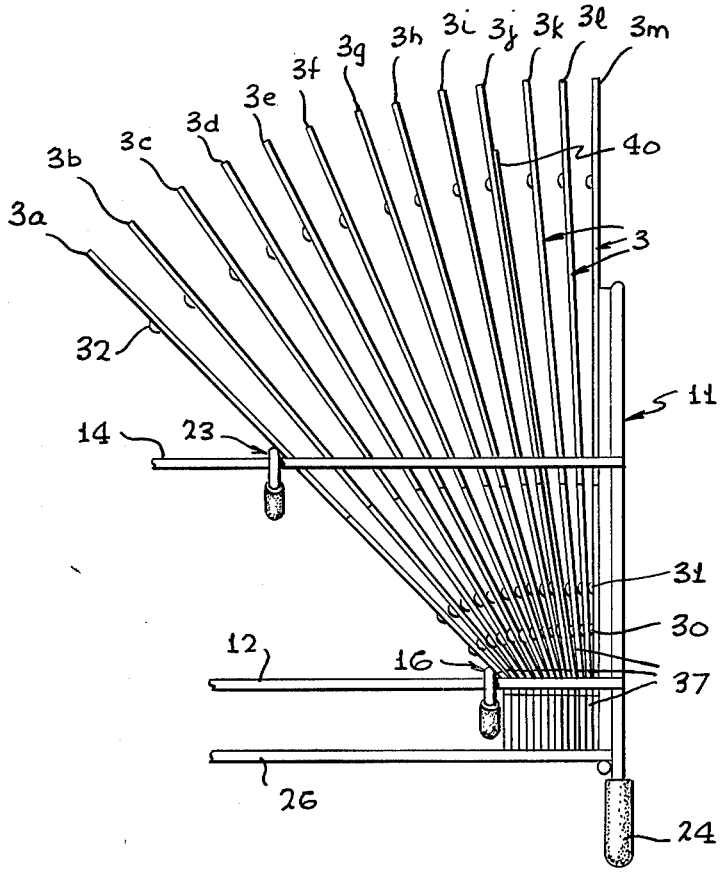
FIG. 3 is a view similar to that of FIG. 2 but showing the compressors and segregators in a different condition.

In the preferred embodiment which appears in FIG. 1, a wire-framework enclosure 1 is provided to support and retain segregators 3.

The enclosure 1 comprises end assemblies 10 and 11 which retain the segregators 3 longitudinally, preventing motion of the segregators past the end of the enclosure. The enclosure 1 also comprises bottom members 26, which may or may not actually support the segregators. Bottom members 26 primarily act to hold and stabilize the shape of the framework enclosure 1, and to support microfiche cards 40 (FIG. 2) placed between the segregators 3.

The enclosure 1 may also comprise four feet, the wire of the feet being padded and dressed by plastic or rubber covers 24.

Finally, the enclosure 1 comprises two lower longitudinal rails 12 and 13, at opposite sides of the enclosure, and two upper longitudinal rails 14 and 15, also at opposite sides. These four rails retain the segregators laterally. The two lower rails 12 and 13 also coact with notches formed as at 33 in the side edges of the segregators to retain the segregators vertically while permitting their longitudinal motion within the enclosure.

The segregators 3 are cut away at both sides, as at 34, to clear the upper rails 14 and 15.

Two transverse compressor rods 16 and 23 are positioned across the enclosure. These transverse compressor rods are referred to hereinafter simply as "compressors".

The ends 19 and 20 of the lower compressor 16 are bent tightly at 17 and 18, respectively, around the respective lower rails 12 and 13. This arrangement holds the lower compressor 16 to the lower rails 12 and 13, while permitting the lower compressor 16 to slide longitudinally within the enclosure, along those rails. However, the tightness of the bends at 17 and 18 applies frictional damping to the sliding motion, sufficient to hold the compressor at the position where it is placed by the user.

Similarly and for like purposes the upper transverse rod 23 is bent tightly partway around the upper rails 14 and 15.

The end portions 19 and 20 of the lower compressor 16 are each at an acute angle with the main transverse portion of the compressor 16; that is, the compressor rod 16 is bent partway around the rails 12 and 13, through an angle greater than 90 degrees. The end portions 19 and 20 are protected and dressed as by plastic or rubber covers 21 and 22, respectively.

Each segregator is embossed in a pattern of points as at 30 and 31, preferably in a zone between the height of the lower rails 12 and 13 and the height of the upper rails 14 and 15. The segregators are also preferably embossed in an additional pattern of points as at 32, nearer the upper edges of the segregators.

Other patterns may be substituted, if desired, in both areas; however, I have found the use of numerous embossed points, or dots, in the desired zones to be satisfactory.

The lower embossing pattern 30, 31 increases the effective thickness of each segregator in the zone described earlier, and the upper embossing pattern 32 increases the effective thickness of each segregator nearer its upper edge.

The lower embossing pattern aids in the fanning of the file, in coaction with the side rails 12, 13, 14 and 15, the notches 33 and the compressors 16 and 23, in a manner to be described hereunder. The upper embossing pattern tends to retain the segregators in a parallel relationship when they are not fanned.

The fanning effect is illustrated in FIGS. 2 and 3. In the first of these, the segregators 3*a* through 3*m* are shown in a condition produced by a particular setting of the compressors 16 and 23 longitudinally along their respective rails 12 (and 13, not shown here) and 14 (and 15, not shown).

In this setting the lower compressor 16 is placed far enough away from the end assembly 11 to accommodate the total effective widths of the segregators 3*a* through 3*m* with embossing 31, without substantial distortion of the generally planar character of the segregators. In this condition the embossing 31 of segregators 3*f* through 3*m* serves to fan these segregators apart at roughly constant angles, so that these eight cards take on very nearly the relative orientation of spokes of a wheel. The angles between adjacent segregators are hereinafter called "intercard angles".

The intercard angles are established by the touching of the segregators at their lower edges, in the region 35, coacting with the constant separation of the segregators at a constant "radius" above the lower edges (the height of the embossing pattern 31 above the lower edges).

Segregators 3*a* through 3*e* are prevented from assuming this same configuration by the setting of upper compressor 23 relatively close to the end assembly 11. If the compressor 23 were moved backward away from end assembly 11 (that is, to the left in the drawing), segregators 3*a* through 3*e* would at first all follow the compressor 23, until segregator 3*e* reached the same intercard angle relative to segregator 3*f* as already obtains between each pair of the segregators 3*f* through 3*m*. Segregator 3*e* would then stop, while the rest of segregators 3*a* through 3*d* continued to follow the compressor 16. This action would continue, with segregators 3*d*, then 3*c*, then 3*b* and finally 3*a* assuming generally the same fanned orientation as the already fanned segregators 3*e* through 3*m*. If the compressor 23 were then moved further away from end assembly 11, some slight additional fanning effect would be produced by the bending under their own weight of some of the cards 3*a* through, say, 3*h* or 3*j*.

On the other hand, if the compressor 23 were moved forward longitudinally, toward end assembly 11, the distance between segregator 3*f* and segregator 3*g* would be decreased until segregators 3*f* and 3*g* assumed a parallel relation; then the pack of segregators 3*a* through 3*g* would be moved as a group toward parallelism with segregator 3*h*, and so on until all the segregators 3*a* through 3*m* assumed a parallel and generally vertical relationship, with the compressor 23 in a position directly above, or nearly so, the lower compressor 16.

The fanned and parallel orientations of the segregators as described above depend on the simple geometrical relationships of the segregator thicknesses and embossing patterns. No significant distortion of the segregators comes into play.

However, a very different fanning action occurs when the lower compressor 16 is moved closer to the end assembly 11 than the total of the effective thicknesses of the segregators 3*a* through 3*m*, as illustrated in FIG. 3. Here the segregators deform as by bending in the region 37, near their lower edges, to accommodate the compression by the lower compressor 16 while also touching at their lower edges and accommodating the total of the effective thicknesses of the segregators 3*a* through 3*m* at the lower embossing 31. For simplicity the sharpness of the bend has been exaggerated in FIG. 3, but it will be understood that the actual radius of curvature for each of the segregators is generally greater than that shown, and the region 37 of bending extends from somewhat above to somewhat below lower compressor 16. The segregators are bent so that they touch each other in a region above their bottom edges, rather than only at the very edges, resulting in an effective foreshortening of the earlier-mentioned "radius" below the embossing 31. That is, the wheel-spoke pattern mentioned earlier now has the same constant separation as before at the embossing 31, but the effective center of the spoke wheel is moved upward slightly while the top of the rim is kept at the same height. This forces the cards to fan apart at greater angles, so the upper edge of the rearmost card actually moves backward away from the end assembly 11, in response to forward motion of the lower compressor 16.

This somewhat startling behavior is not possible in prior-art systems such as that of Spees, wherein no deforming compression in the mode shown here is possible. In the present invention this compression is produced by a lower compressor, of limited vertical extent, being positioned at a height between the bottom edges of the segregators and their increased-thickness zone. In addition, a separate and independently adjustable upper compressor is desirable to make optimum use of the compression mode illustrated.

The upper compressor 23 is shown in FIG. 3 at a position which just permits back segregator 3*a* to fan at the same intercard angle as the other segregators 3*b* through 3*m*. If the upper compressor 23 were moved backward, once again a slight additional fanning would result, accentuated toward the rear of the group of segregators, due to the segregators bending under their own weight. If the upper compressor 23 were moved forward instead, the result would be to move the upper edges of the segregators together. This would bring the segregators into parallelism (ignoring deformation)—first at the rear of the group, with a configuration analogous to that of FIG. 2, and finally toward the front of the group, ending with the upper compressor 23 in a position directly above, or nearly so, the lower compressor 16. In this case, however, the group of segregators would be held together more tightly than in the analogous vertical position discussed earlier, and would be deformed by compression both above and below the lower embossing 3*a*.

A third general category of card positions occurs when the lower compressor is moved backward away from the end assembly 11, so far that the lower edges of the segregators are not forced to touch each other, even in part of the group; that is, the region 35 of FIG. 2 does not exist. This situation is not illustrated, but is easily visualized inasmuch as the segregators in this situation behave as if they were of uniform thickness, or in other words they behave as ordinary file cards in a card file, except that they are retained by the coaction of the notches 33 (FIG. 1) and rails 12 and 13.

In view of the foregoing discussion it may be understood that through manipulation of the two independently adjustable compressors 16 and 23 slidably along the respective rails 12 and 13, and 14 and 15, the user of a filing system constructed in accordance with my invention may fan apart various fractions of the group of segregators 3, and by various intercard angles. In doing so the user may alternately make use of two different modes of fanning illustrated in FIGS. 1 and 2 respectively. If he wishes, the user may sometimes use the filing system as an ordinary card file, as also described above. The availability of these three modes of use in the same filing system, at the user's immediate option, is an advantage of my invention.

A multiplicity of microfiche cards may be placed in the filing system, one between each pair of segregators, as exemplified by the single microfiche card 40 shown in FIG. 2. These microfiche cards are placed loosely in the file, being supported by bottom members 26 to the extent required; however, the microfiche cards are also retained in position by electrostatic attraction between each of them and the respective rearward segregator. The segregators are made of a material selected for such affinity, namely calendered polyvinyl chloride, a common plastic which tends to adhere electrostatically to the usual microfiche materials. This arrangement has the added advantage that the microfiche cards will not fall out of the enclosure even if the compressors are released and the enclosure is inverted, and only come out of the enclosure slowly if the enclosure while inverted is shaken or jarred.

While my invention has been described in terms of a filing system containing 13 segregators, it is also intended for use with even substantially greater or smaller numbers of segregators, as user requirements may dictate.

(Segregators may of course be removed from or added to the file by flexing or angling them slightly so that the wider portions near the notches fit between the rails 12, 13 and 14, 15.)

My invention has been described with respect to an embodiment using wire-frame construction, wherein the rails 12, 13, 14 and 15 are structural elements as well as support, guidance or retention elements. However, it is to be understood that my invention is not limited to embodiments using such construction or such dual function.

Finally, while my invention has been described in terms of a microfiche filing system, other applications are not precluded and are within the scope of the appended claims.

What is claimed is:

1. A variable-visibility information storage and retrieval system for holding and displaying information cards between file segregators, comprising;

a multiplicity of generally planar file segregators having top, bottom and side edges;

enclosure means for supporting and retaining said file segregators in a row, one in front of another, said enclosure means having front and back ends;

engaging means for releasably securing said file segregators to said enclosure means, said engaging means comprising a first pair of parallel rails mounted to the enclosure means longitudinally with respect to the row of segregators, and notches defined in the edges of said segregators releasably and slidingly engaging said rails; and compression means for controllably bending and fanning said file segregators, said compression means comprising separate, spaced lower and upper independently adjustable compressors mounted to said enclosure means and controllably compressing said segregators together against one end of said enclosure means along a first line near said bottom edges and along a second line more distant from said bottom edges, respectively.

2. The system of claim 1, wherein said lower compressor comprises:

a first rod slidably mounted to said first pair of rails transversely to said row of segregators for movement longitudinal of said row; and means associated with said first rod for resisting such longitudinal movement of said first rod.

3. The system of claim 2, wherein the ends of said first rod are in tensioned frictional slidable engagement with said first pair of rails.

4. The system of claim 2, comprising:

a second pair of parallel rails mounted to the enclosure means longitudinally with respect to the row of segregators, said upper compressor being slidably mounted to said second pair of rails transversely to said row of segregators for movement longitudinal of said row; and means associated with said upper compressor for restricting such longitudinal movement of said upper compressor.

5. The system of claim 4, wherein said upper compressor comprises a second rod having its ends in tensioned frictional slidable engagement with said second pair of rails.

6. The system of claim 1, wherein the effective thickness of each segregator is greater in a zone between said first and second lines than below the first line.

7. The system of claim 6, comprising a plurality of protuberances disposed on the surface of each of said segregators within said zone.

8. The system of claim 6 in combination with a multiplicity of such information cards positioned between said segregators.

9. A variable-visibility information storage and retrieval system for holding and displaying information cards between file segregators, comprising:

a multiplicity of generally planar resilient file segregators having top, bottom and side edges, said segregators being of greater effective thickness in a transverse zone spaced from their bottom edges than elsewhere outside said zone;

enclosure means for supporting and retaining said file segregators in a row, one in front of another, said enclosure means having front and back ends; and compression means for controllably bending and fanning said file segregators, said compression means comprising separate, spaced lower and upper independently adjustable compressors mounted to said enclosure means between the row of segregators and one end of the enclosure means and controllably compressing said segregators together against the opposite end of said enclosure means along a first line intermediate said bottom edges and said zone, and along a second line intermediate said first line and said top edges, respectively.

10. The system of claim 9 in combination with a multiplicity of such information cards positioned between said segregators.

* * * * *